United States Patent [19]

Witkin

[11] 4,295,284

[45] Oct. 20, 1981

[54] DRYER RANGE

[75] Inventor: Philip M. Witkin, Greenville, S.C.

[73] Assignee: Marshall and Williams Company, Greenville, S.C.

[21] Appl. No.: 54,861

[22] Filed: Jul. 5, 1979

[51] Int. Cl.[3] ..... F26B 13/02; D06C 3/02

[52] U.S. Cl. ..... 34/155; 26/92; 34/158

[58] Field of Search ..... 34/156, 158, 155; 26/92

[56] References Cited

U.S. PATENT DOCUMENTS 2,916,796 12/1959 Sibel ..... 34/158 X 3,739,491 6/1973 Creapo et al. ..... 34/156

3,837,551 9/1974 Schregenberger ..... 34/156 X 4,094,077 6/1978 Schrader et al. ..... 34/158 X

*Primary Examiner*—Robert Mackey

*Attorney, Agent, or Firm*—Bailey, Dority & Flint

[57] ABSTRACT

A dryer range and the like wherein improved air flow means are provided for retaining heated air in contact with the web for maximum utilization of the heated air and for facilitating return of the spent air for reheating or for exhausting into the atmosphere to remove excess moisture or volatile material such as knitting oil and the like from the range. A pair of opposed air flow retaining baffles are carried by spaced plenums adjacent the fabric or web for thus retaining the air directed in streams against the web.

2 Claims, 5 Drawing Figures

Fig. 2.
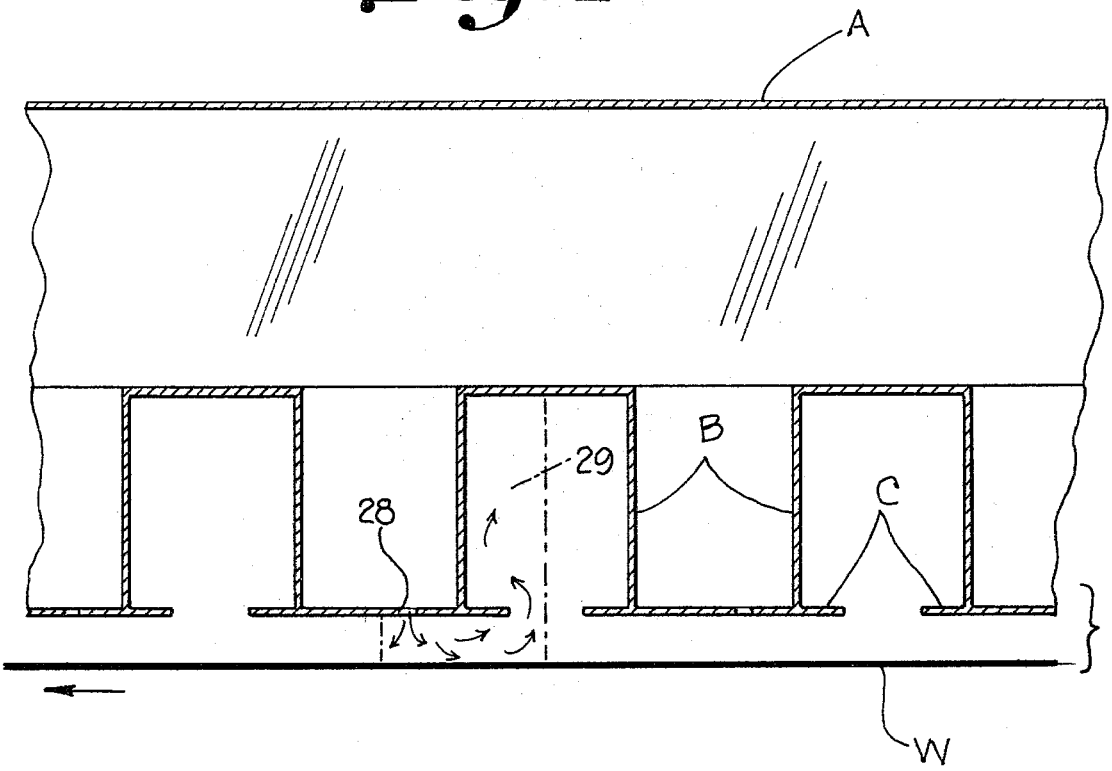
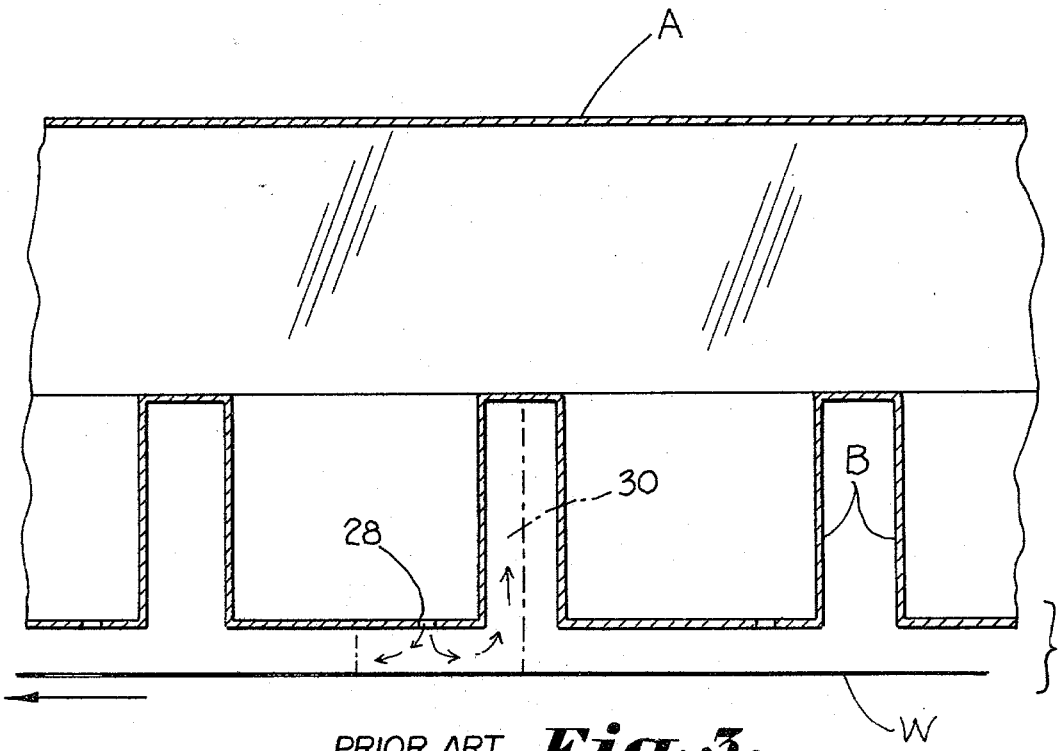
PRIOR ART Fig. 3.

Fig. 4.
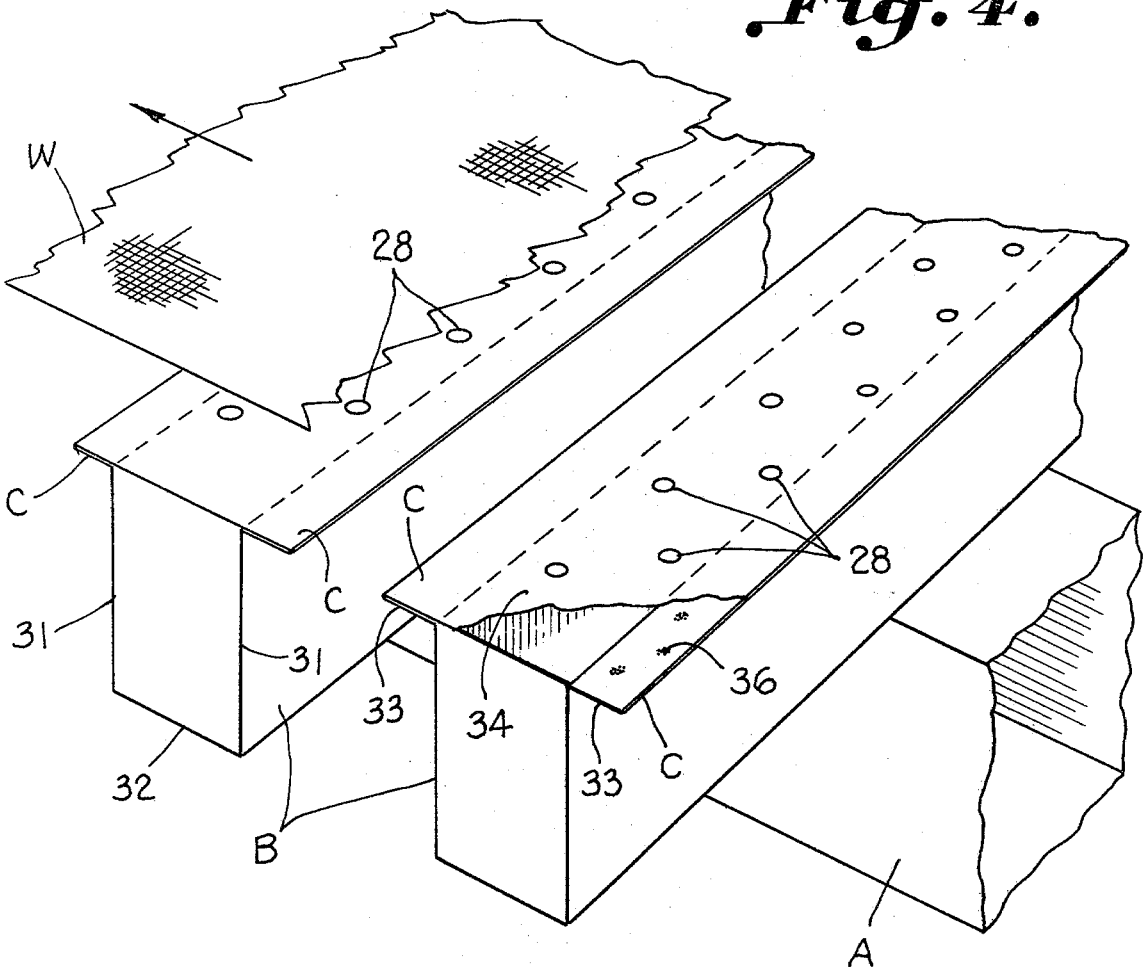
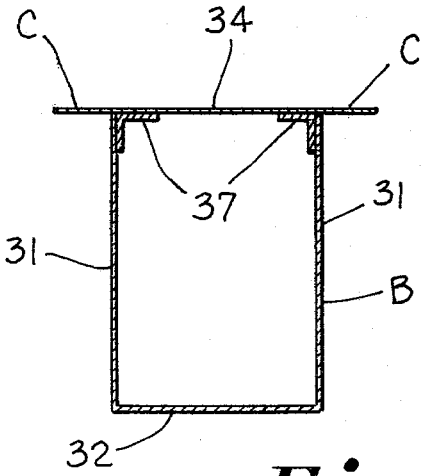
Fig. 5.

DRYER RANGE

BACKGROUND OF THE INVENTION

Textile finishing ranges utilize an insulated outer wall with tenter means carried within for moving the fabric or web through the heated area where air is directed against the web. Film ovens or other similar devices utilize similar enclosures with tenter frame means and the like to move a web such as film rather than fabric as described herein. The apparatus is also thought to be useful in connection with foraminous webs but its utility may lie especially in connection with fabric where there is no substantial flow through the web.

U.S. Pat. No. 4,074,841 discloses dryer apparatus having plenums or blower boxes especially designed for conveying material through a dryer by air pressure flotation. U.S. Pat. No. 3,384,980 discloses a dryer for a web material wherein the blower boxes have, as an incidental feature, a short lip extending to either side. However, the blower boxes are not arranged to face-to-face relation and do not contemplate the structure or the results achieved by the invention hereof.

Prior finishing ranges generally include a single manifold means which extends entirely across the ducts or blower boxes. It has been found even with manifold means which do not extend entirely across that uneven drying of the fabric occurs as a result of increased cross of transverse velocity of air necessitated in areas bounded on one or both sides by the manifold means.

It is an important object of this invention to reduce cross-flow interference of spent air with impinging air and since the air flow retaining baffles hereof thus eliminate an unacceptably uneven rate of heat transfer to the cloth, the cloth is heated and dries at a constant rate so that dye migration and uneven heat setting and curing is avoided. The apparatus constructed in accordance with the invention may be used for heat setting, heat curing or drying and similar processes.

SUMMARY OF THE INVENTION

A dryer apparatus or finishing range is provided for use in connection with a web such as textile material which includes plenums or blower boxes arranged facing one another in transverse opposed relation above and below the web as it passes through the dryer. The blower boxes need not necessarily be directly opposed as shown, but may be spaced or offset. Each blower box includes horizontal flanges or lips constituting air flow retaining baffles extending from both sides of the blower box adjacent the fabric which enlarge the path for transverse flow of heated air in the area bounded by the manifold and so reduces the velocity of cross-flow air and, therefore, reduces the cross-flow inteference of spent air with the air impinging upon the web. The result is that a relatively even rate of heat transfer to the web of material is provided so that the material is dried or heated at a constant rate thereby reducing dye migration and uneven heat setting and curing.

BRIEF DESCRIPTION OF THE DRAWINGS

The invention will be more readily understood from a reading of the following specification and by reference to the accompanying drawings forming a part thereof, wherein an example of the invention is shown and wherein:

FIG. 2 is a longitudinal sectional elevation through a longitudinal manifold and across air plenums indicating minimized cross-flow velocity for a given delivery of heated air to the fabric due to the relatively large cross-section of the flow path bounded by broken lines.

FIG. 3 is a longitudinal sectional elevation similar to FIG. 2 illustrating the prior art wherein the cross-section of the path for air flow in the area bounded by a longitudinal manifold is constructed or minimal in comparison with the path of FIG. 2 so as to illustrate the reason for increased transverse air velocity with interference with impingement of the air directed by the nozzle means against the web, FIG. 4 is a perspective view illustrating fabric moving across the plenums and air flow retaining baffles constructed in accordance with the present invention, and FIG. 5 is a transverse sectional elevation taken across a plenum illustrating a modified construction thereof.

DESCRIPTION OF A PREFERRED EMBODIMENT

Figure 1:
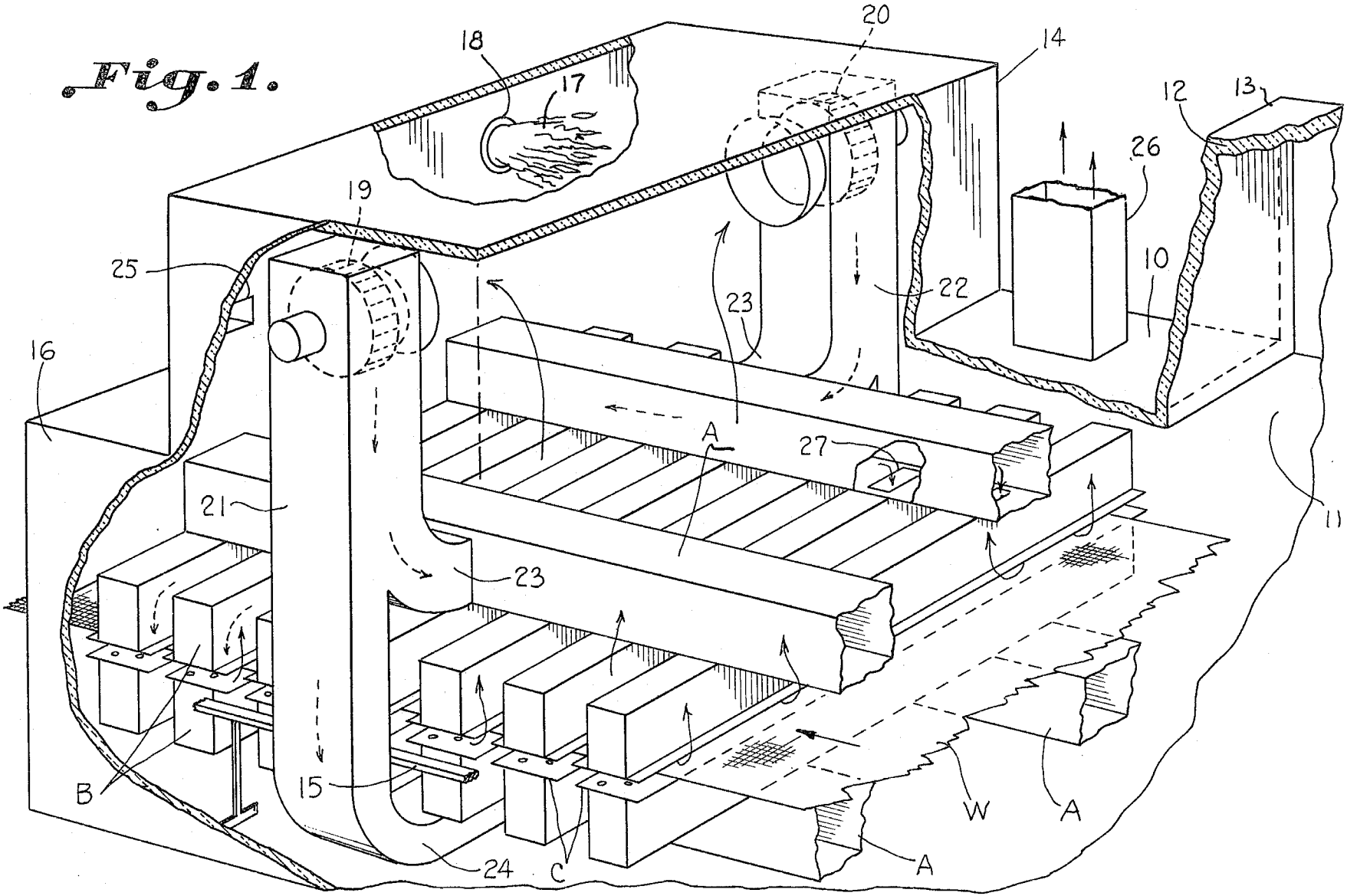
FIG. 1 is a schematic perspective view, with parts omitted and parts broken away, illustrating a range constructed in accordance with the present invention wherein opposed plenums carry air flow retention flanges or baffles.

The drawings illustrate a finishing range and the like having a plurality of stages with spaced means supplying heated air and the like to longitudinal manifold means A for treating a web moving longitudinally through the range. Spaced transverse plenums B are provided in superposed relation to the manifold means receiving heated air therefrom. The plenums each have a closure member opposite the web carrying a plurality of spaced nozzles directing heated air against the web, and a pair of sides extending marginally of said closure member. A pair of opposed air flow retaining baffles C are carried by each plenum extending laterally outwardly adjacent the closure member. Thus, heated air is retained in contact with the web while reducing cross velocity adjacent the manifold equalizing treatment of the web.

A multi-stage finishing rage of the type often used in finishing textile fabric is illustrated in FIG. 1 wherein insulated walls are provided by spaced sheet metal outer walls 10 with inner walls 11 having insulating material such as fiberglass 12 sandwiched therebetween. An intermediate stage of the range includes a penthouse 13 illustrated in FIG. 1 whereas a delivery zone includes the penthouse 14 preceding the exit end from which the fabric or web W emerges from the range. The range illustrated has means for introducing a web in the form of textile fabric W, carrying same from the entrance through the exit end of the range illustrated as including a tenter frame with a rail 15 which carries the familiar tenter gripper and chain arrangement (not shown). The web is delivered from the exit end 16 of the range and moves in the direction of the arrow to suitable takeup apparatus.

As is typical of the heating of air in the other zones, the air of the penthouse 14 is heated by the flame 17 introduced therein through the wall of the penthouse by the nozzle 18. The heated air is carried by fans 19 and 20 to transversely spaced manifold means A through respective duct means 21 and 22. The duct means each include upper and lower delivery portions 23 and 24, respectively, for providing sufficient spacing from the ends of the plenums B to accommodate the rail 15 of the tenter frame. Makeup or fresh air is provided to the system through an inlet 25 in the penthouse 14 and exhaust air is pulled through an exhaust duct 26 by suitable means such as a fan or other device for inducing air flow. Air flows from the fans 19 and 20 in the direction of the arrows in FIG. 1 through the ducts 21 and 22 and through respective delivery ducts 23 and 24 into upper and lower spaced longitudinal manifold means A through suitable openings 27 into the respective ducts B which are transversely disposed and longitudinally spaced in opposed relation between upper and lower manifold means A. The manifold means A may include one manifold or preferably spaced manifolds on one or preferably both sides of the web. As illustrated, the plenums are preferably in opposed aligned relation above and below the web.

From the plenums B, air is shown in FIG. 1 flowing in the direction of the arrows, first laterally and then upwardly between the manifold for delivery into the exhaust duct 26 or into the penthouse 14 for being heated again and directed against the fabric by suitable nozzles 28, as best seen in FIGS. 2 through 4.

As shown schematically in FIG. 2, the nozzles 28 deliver air into an enlarged cross flow path or area, for ease of illustration being shown effectively between the broken lines 29, as opposed to the constricted area illustrated in FIG. 3 between the broken lines 30 illustrating the prior art.

FIG. 4 illustrates the construction of the ducts or blower boxes wherein a U-shaped sheet metal portion is illustrated as having vertical sides 31 with a base 32. Free ends of the sides are out-turned as at 33 and a closure member 34 is tack welded thereto as at 36. The nozzles 28 are illustrated in the form of holes in the closure member but may be more elaborate nozzle means as desired.

FIG. 5 illustrates a modified form of the invention wherein the U-shaped member having a base 32 carrying opposed sides 31 has angles adjacent the inner free end portion thereof illustrated at 37 with a horizontal leg for carrying a closure member 34 which forms the air flow retaining baffles C.

It is thus noted that air flow is provided with minimal variation under or in the areas bounded by the manifold since the cross-flow velocity is reduced. Thus dye migration, together with the shading problems that go with uneven drying, is avoided because faster drying in that area would result from greater air flow is avoided. The overall drying rate is increased and air utilization is maximized. The prior art construction, in order to minimize cross-flow velocity variations, would of necessity utilize a lesser number of nozzles if sufficient retention of air in contact with the web is to be achieved, which would not result is as much drying.

Heated air may be applied to only one side of the cloth. Equal pressure or improved air return is achieved because there is less area restriction. The nozzle boxes or ducts may have spaced around holes with pattern repetition for good coverage or slits or other nozzle means may be provided.

The purpose of the spaced manifolds is to allow spent air which has impinged on the cloth to return to recirculating fans with minimal interference, while permitting nozzle carrying plenums or boxes to be close together, and to provide good side-to-side air distribution in the oven. A single narrow manifold of width less than the plenum length may be utilized with advantageous results. The baffles direct impinged air to the fabric and holds it in effective contact with the cloth until an optimum amount of heat has been transferred to the fabric. The baffles provide a relatively large return area for cross-flow constrained by the fabric, manifolds and plenums with the result that cross-flow has a minimum amount of interference with the nozzle discharge.

While a preferred embodiment of the invention has been described using specific terms, such description is for illustrative purposes only, and it is to be understood that changes and variations may be made without departing from the spirit or scope of the following claims.

What I claim is:

1. A dryer range having spaced means supplying heated air to upper and lower longitudinal manifold means for treating a web moving longitudinally through the range comprising:

spaced transverse plenums carried above said lower manifold means receiving heated air therefrom;

spaced transverse plenum carried below said upper manifold means receiving heated air therefrom;

said plenums each having a closure member opposite said web carrying a plurality of spaced nozzles therealong directing heated air against said web, and opposed sides extending marginally of said closure member;

said spaced transverse plenums being carried both above and below said cloth communicating with respective upper and lower manifold means;

air flow retaining baffle means carried by each of said plenums extending laterally outwardly adjacent said closure member defining an air passage adjacent an edge thereof;

said air retaining baffle means providing a wide face confronting opposing sides of said fabric for holding heated air against said fabric while allowing sufficient spacing relative to the width of said air passage between said opposed sides of adjacent plenums to facilitate a smooth uniform flow and removal of spent air such that moisture is evenly removed from said web, and the area of entrance of said air passage being greater than the area of said nozzles.

2. The structure set forth in claim 1 wherein said baffle means includes opposed baffles extending between each of said plenums.

* * * * *